US008047264B2

(12) United States Patent
Bowman et al.

(10) Patent No.: US 8,047,264 B2
(45) **Date of Patent: *Nov. 1, 2011**

(54) CASTING DELIVERY NOZZLE

(75) Inventors: Brian E. Bowman, Waveland, IN (US); Rama Ballav Mahapatra, Brighton-Le-Sands (AU); Peter A. Woodberry, Austinmer (AU)

(73) Assignee: Nucor Corporation, Charlotte, NC (US)

( * ) Notice: Subject to any disclaimer, the term of this patent is extended or adjusted under 35 U.S.C. 154(b) by 133 days.

This patent is subject to a terminal disclaimer.

(21) Appl. No.: 12/403,876

(22) Filed: Mar. 13, 2009

(65) Prior Publication Data

US 2010/0230070 A1 Sep. 16, 2010

(51) Int. Cl.
*B22D 11/06* (2006.01)
*B22D 11/10* (2006.01)
*B22D 41/50* (2006.01)

(52) U.S. Cl. ..... 164/480; 164/428; 164/437; 164/488; 222/607

(58) Field of Classification Search ..... 164/480, 164/428, 437, 488; 222/606, 607
See application file for complete search history.

(56) References Cited

U.S. PATENT DOCUMENTS

| | | | | |
|---|---|---|---|---|
| 3,991,815 | A | 11/1976 | Fastner et al. | |
| 5,716,538 | A | 2/1982 | Poloni et al. | |
| 4,487,251 | A | 12/1984 | Cahoon et al. | |
| 4,694,887 | A | 9/1987 | Matsui et al. | |
| 5,221,511 | A | 6/1993 | Fukase et al. | |
| 5,227,078 | A | 7/1993 | Augustine | |
| 5,402,993 | A | 4/1995 | Hofmann et al. | |
| 5,691,061 | A | 11/1997 | Hanse et al. | |
| 5,785,880 | A | 7/1998 | Heaslip et al. | |
| 5,840,206 | A | 11/1998 | Gacher et al. | |
| 5,857,514 | A | 1/1999 | Shook et al. | |
| 5,944,261 | A | 8/1999 | Heaslip et al. | |
| 5,958,280 | A | 9/1999 | Reichelt et al. | |
| 6,012,508 | A | 1/2000 | Folder | |
| 6,016,941 | A | 1/2000 | Damle | |
| 6,027,051 | A | 2/2000 | Heaslip et al. | |
| 6,125,917 | A | 10/2000 | Cassar et al. | |
| 6,220,335 | B1 * | 4/2001 | Folder et al. | 164/437 |
| 6,279,790 | B1 | 8/2001 | Nomura et al. | |
| 6,410,469 | B1 | 6/2002 | Hoover et al. | |
| 6,425,505 | B1 | 7/2002 | Heaslip et al. | |
| 6,464,154 | B1 | 10/2002 | Heaslip et al. | |
| 6,586,355 | B2 | 7/2003 | Hoover et al. | |

(Continued)

FOREIGN PATENT DOCUMENTS

AU 8036691 A 1/1992

(Continued)

*Primary Examiner* — Kevin P Kerns
(74) *Attorney, Agent, or Firm* — Hahn, Loeser & Parks LLP; Arland T. Stein

(57) ABSTRACT

A metal strip casting apparatus and method of casting continuous metal strip include assembling a pair of counter-rotatable casting rolls having casting surfaces positioned laterally forming a nip between for casting, and delivering molten metal through a delivery nozzle disposed above the nip to form a casting pool supported on the casting rolls. The delivery nozzle includes at least one segment having a main portion and an end portion and an inner trough extending longitudinally through the main portion and into the end portion with end walls at opposite ends thereof, the inner trough communicating with outlets adjacent bottom portions formed in each segment adapted to deliver molten metal to a casting pool and the end portion having a reservoir portion having passages adapted to deliver molten metal to a casting pool.

12 Claims, 7 Drawing Sheets

U.S. PATENT DOCUMENTS

| | | | | |
|---|---|---|---|---|
| 6,932,250 | B2 | 8/2005 | Bederka | |
| 7,063,242 | B2 | 6/2006 | Marti et al. | |
| 7,926,549 | B2 * | 4/2011 | Cooper et al. | 164/480 |
| 7,926,550 | B2 * | 4/2011 | Blejde et al. | 164/480 |
| 2005/0211411 | A1 * | 9/2005 | Fukase et al. | 164/480 |
| 2008/0173424 | A1 * | 7/2008 | Cooper et al. | 164/463 |
| 2008/0264599 | A1 * | 10/2008 | Blejde et al. | 164/463 |

FOREIGN PATENT DOCUMENTS

| | | | |
|---|---|---|---|
| AU | 732559 | B2 | 4/2001 |
| EP | 0829320 | B1 | 3/1998 |
| EP | 0850712 | B1 | 7/1998 |
| GB | 2317132 | A | 3/1998 |
| WO | 2005077570 | A1 | 8/2005 |
| WO | 2007056801 | A1 | 5/2007 |
| WO | 2008086580 | A1 | 7/2008 |

* cited by examiner

CASTING DELIVERY NOZZLE

BACKGROUND AND SUMMARY

This invention relates to making thin strip and more particularly casting of thin strip by a twin roll caster.

It is known to cast metal strip by continuous casting in a twin roll caster. Molten metal is introduced between a pair of counter-rotating horizontal casting rolls which are cooled so that metal shells solidify on the moving roll surfaces, and are brought together at the nip between them to produce a solidified strip product delivered downwardly from the nip between the rolls. The term "nip" is used herein to refer to the general region at which the rolls are closest together. The molten metal may be poured from a ladle into a smaller vessel or tundish/distributor, from which it flows through a metal delivery nozzle located above the nip, which directs the molten metal to form a casting pool supported on the casting surfaces of the rolls above the nip. This casting pool is typically confined at the ends of the casting rolls by side plates or dams held in sliding engagement adjacent the ends of the casting rolls.

In casting thin strip by twin roll casting, the metal delivery nozzles receive molten metal from the movable tundish and deposit the molten metal in the casting pool in a desired flow pattern. Previously, various designs have been proposed for delivery nozzles involving a lower portion submerged in the casting pool during a casting campaign, and having side openings through which the molten metal is capable of flowing laterally into the casting pool outwardly toward the casting surfaces of the rolls. Examples of such metal delivery nozzles are disclosed in Japanese Patent No. 09-103855 and U.S. Pat. No. 6,012,508. In prior art metal delivery nozzles, there has been a tendency to produce thin cast strip that contains defects from uneven solidification at the chilled casting surfaces of the rolls.

The present invention provides an apparatus and method for continuous thin strip casting that is capable of substantially reducing and inhibiting such defects in the cast strip, and at the same time reducing wear in the delivery nozzles and the costs in thin strip casting. By testing, we have found that a major cause of such strip defects is thinning of the shells during casting. It is believed that the thinning of the shells is caused by localized high volume flow causing washing away of the shells during formation. Such thinning of the shells can result in ridges in the cast strip. We have found by changing the delivery nozzle that the flow of molten metal into the casting pool can be made more even and closer to uniform. This improved flow from the delivery nozzle into the casting pool is particularly notable in the region where the casting pool meets the casting surfaces of the rolls, generally known as the "meniscus" or "meniscus regions" of the casting pool and provides more even flow of molten metal.

In the past, the formation of pieces of solid metal known as "skulls" in the casting pool in the vicinity of the confining side plates or dams have been observed. The rate of heat loss from the casting pool is higher near the side dams (called the "triple point region") due to conductive heat transfer through the side dams to the casting roll ends. This localized heat loss near the side dams has a tendency to form "skulls" of solid metal in that region, which can grow to a considerable size and fall between the casting rolls and causing defects in the cast strip. An increased flow of molten metal to these "triple point" regions, the regions near the side dams, have been provided by separate direct flows of molten metal to these triple point regions. Examples of such proposals may be seen in U.S. Pat. No. 4,694,887 and in U.S. Pat. No. 5,221,511. Increased heat input to these triple point regions has inhibited formation of skulls.

Australian Patent Application 60773/96 discloses a method and apparatus in which molten metal is delivered to the delivery nozzle in a trough closed at the bottom. Side openings are provided through which the molten metal flows laterally from the nozzle into a casting pool in the vicinity of the casting pool surface. The flow of molten metal into the casting pool was improved; however, unevenness in metal flow adjacent the casting roll surfaces caused washing away and thinning of the shells tending to cause defects in the cast strip. Further, there remained concern for wear on the delivery nozzle caused by the impact of the molten metal due to ferrostatic pressure, and turbulence caused as the molten metal moved through the delivery nozzle to discharge laterally into the casting pool below the meniscus of the casting pool. In addition, there was concern for extending the useful life of the delivery nozzles and in turn reducing the cost of producing thin cast strip.

The present invention provides an improved apparatus for casting metal strip and method of continuously casting metal strip. Disclosed is an apparatus for casting metal strip comprising:

(a) assembling a pair of casting rolls laterally disposed to form a nip between them, (b) assembling an elongated metal delivery nozzle extending along and above the nip between the casting rolls, with at least one segment having a main portion and an end portion and an inner trough extending longitudinally through the main portion and into the end portion with end walls at opposite ends thereof, the inner trough communicating with outlets adjacent bottom portions formed in each segment adapted to deliver molten metal to a casting pool and the end portion having a reservoir portion having passages adapted to deliver molten metal to a casting pool, (c) introducing molten metal through the elongated metal delivery nozzle to form a casting pool of molten metal supported on the casting rolls above the nip, such that molten metal is caused to flow into the inner trough of the delivery nozzle, from the inner trough through the outlets and through the reservoir portion passages into the casting pool, and (d) counter rotating the casting rolls to deliver cast strip downwardly from the nip.

The metal delivery nozzle may have an inner trough including a convex upper surface or, alternatively, a concave upper surface in the bottom portion of each segment.

The metal delivery nozzle may include an end portion having at least one longitudinally extending weir adjacent to the inner trough. The end portion may also include at least one reservoir adjacent the weir and opposite the inner trough.

The metal delivery nozzle may include an end portion having at least one reservoir extending laterally from the inner trough within the end portion.

The metal delivery nozzle may include outlets that are open at an end of the metal delivery nozzle.

Various aspects of the invention will be apparent from the following detailed description, drawings, and claims.

BRIEF DESCRIPTION OF THE DRAWINGS

The invention is described in more detail in reference to the accompanying drawings in which.

DETAILED DESCRIPTION

Figure 1A:
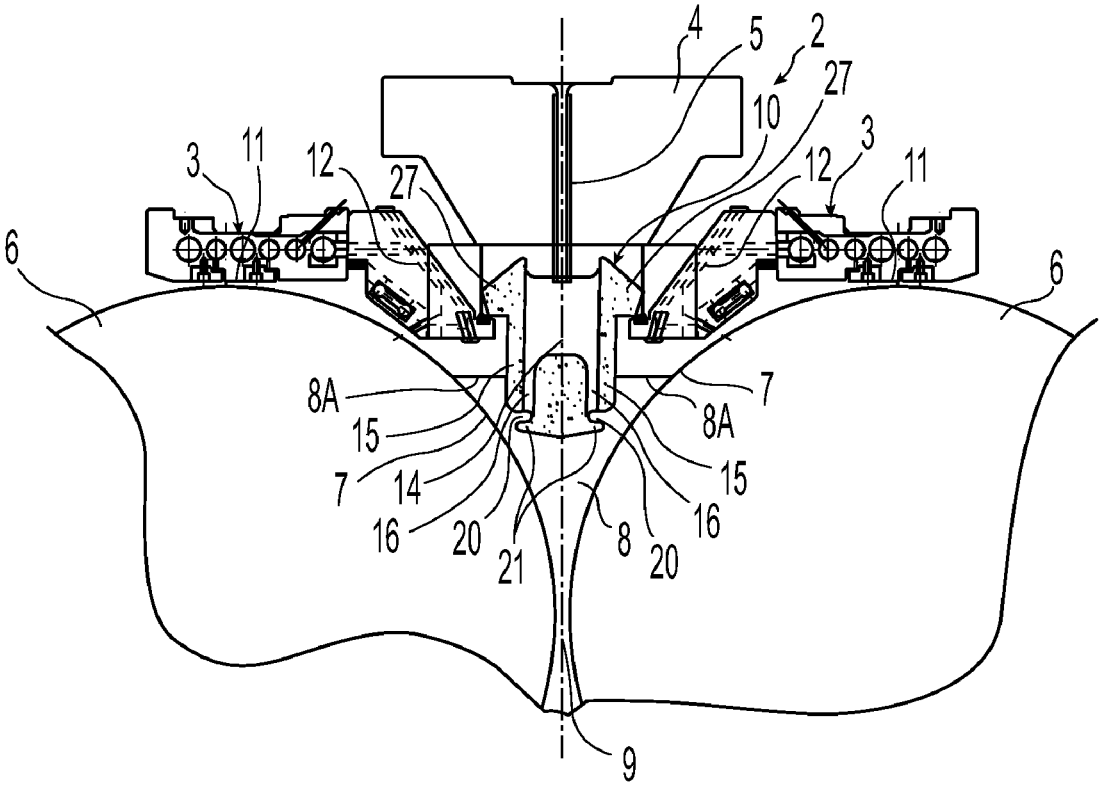
FIG. 1*a* illustrates a cross-sectional end view of a portion of twin roll strip caster with an assembled metal delivery nozzle.

Referring to FIG. 1*a*, the metal strip casting apparatus 2 includes a metal delivery nozzle 10 formed in segments 13 located below a metal distributor 4 (also called a moveable tundish or transition piece) and above casting rolls 6. Casting rolls 6 are laterally positioned with nip 9 formed between them. Metal distributor 4 receives metal from a ladle through a metal delivery system (not shown) and delivers the molten metal to delivery nozzle 10. A shroud 5 may extend from metal distributor 4 and into delivery nozzle 10, for the purpose of transferring molten metal into the segments of delivery nozzle 10. In the alternative, metal distributor 4 may transfer metal to the segments of delivery nozzle 10 via a hole in the bottom of metal distributor 4. Below delivery nozzle 10, a casting pool 8 having surface 8A is formed supported on the casting surfaces 7 of casting rolls 6 adjacent nip 9. Casting pool 8 is constrained at the ends of the casting rolls by side dams or plates (not shown) positioned against the sides of the casting rolls. The segments 13 of the delivery nozzle 10 control molten metal flow into casting pool 8. Generally, segments 13 of the delivery nozzle 10 extend into and are partially submerged in casting pool 8 during the casting campaign. Also shown in FIG. 1*a* is gas control apparatus 3 for maintaining a gas seal 11 with the casting surfaces 7 of casting rolls 6 and maintaining an inert atmosphere of nitrogen and/or argon above the casting pool 8 by blowing such gas through passageways 12 in gas control apparatus 3.

The delivery nozzle 10 includes segments 13, each supported to receive molten metal from the tundish 4. Each segment 13 has an upward opening inner trough 14 to assist in breaking and redirecting the impact of incoming molten metal to the delivery nozzle. As shown, the inner trough 14 of each segment 13 is formed with the bottom portion 21 having a convex upper surface to keep molten metal from pooling in the inner trough during breaks in the flow of molten metal. The flow of molten metal from the inner trough 14 of each segment, communicates with outlets 20 to the casting pool 8, through passages 16.

Figure 1B:
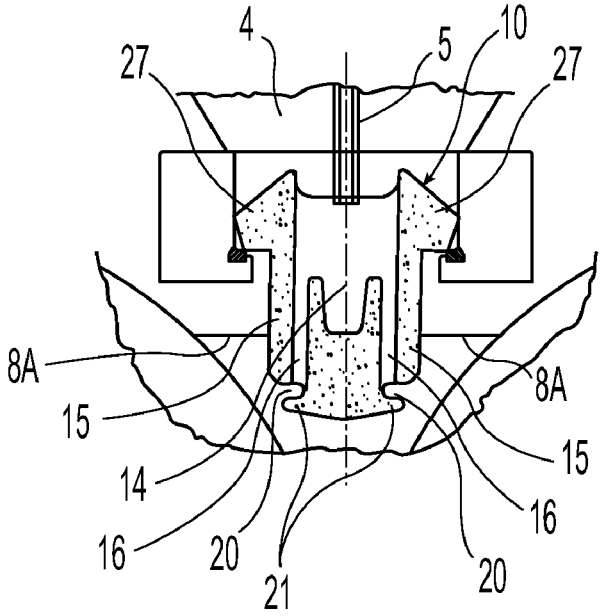
FIG. 1*b* is an enlarged view of a portion of twin roll strip caster similar to FIG. 1*a* except showing a trough with a concave upper surface.

There is shown in FIG. 1*b* an alternative twin roll caster where the inner trough 14 has a concave upper surface. Such a concave upper surface may be used as desired for an alternative flow pattern within the nozzle 10. The inner trough 14 may have any suitable shape as desired.

Figure 2:
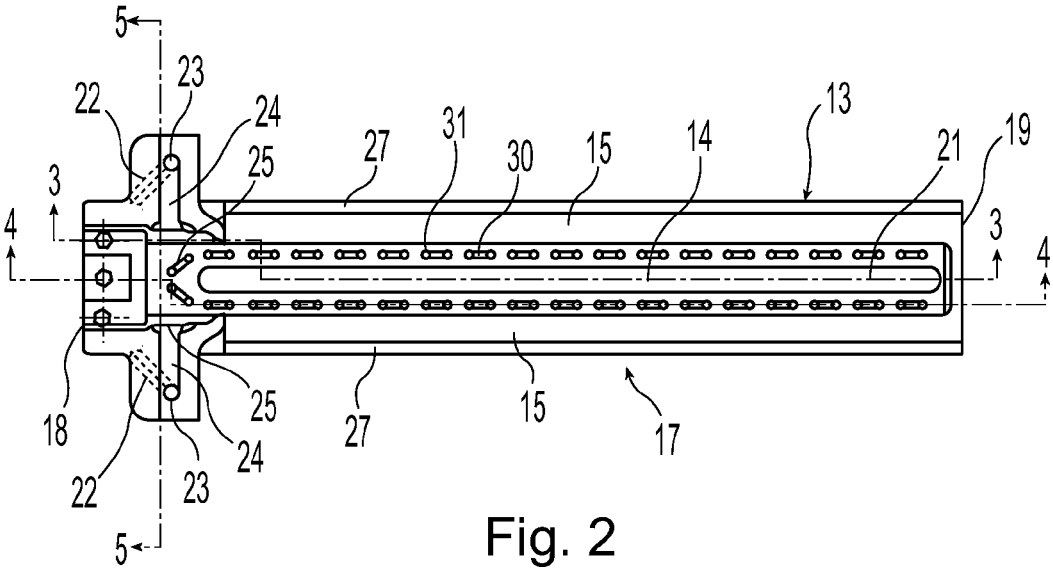
FIG. 2 is a plan view of a segment of a metal delivery nozzle for use in the twin roll caster shown in FIG. 1.
Figure 3:
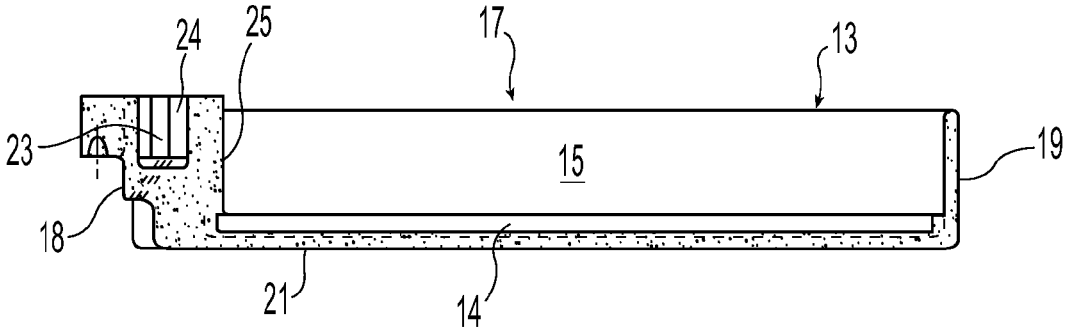
FIG. 3 is a cross-sectional side view taken along line 3-3 of the segment of the metal delivery nozzle shown in FIG. 2.
Figure 4:
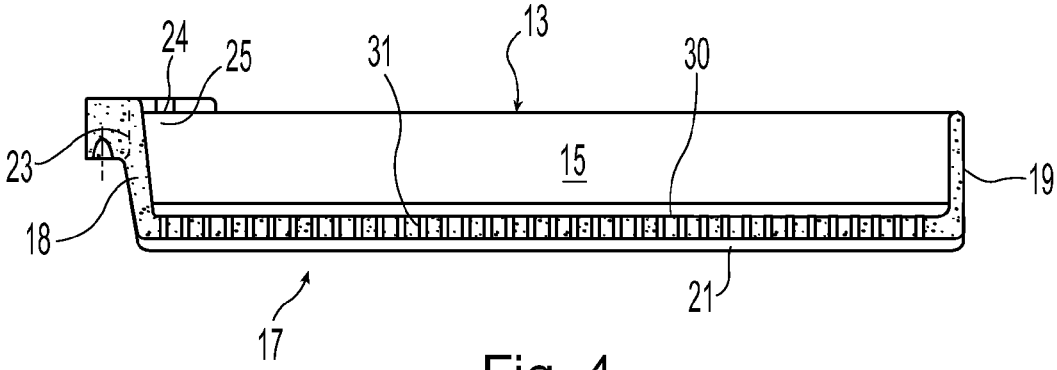
FIG. 4 is a cross-sectional side view taken along line 4-4 of the segment of the metal delivery nozzle shown in FIG. 2.
Figure 7:
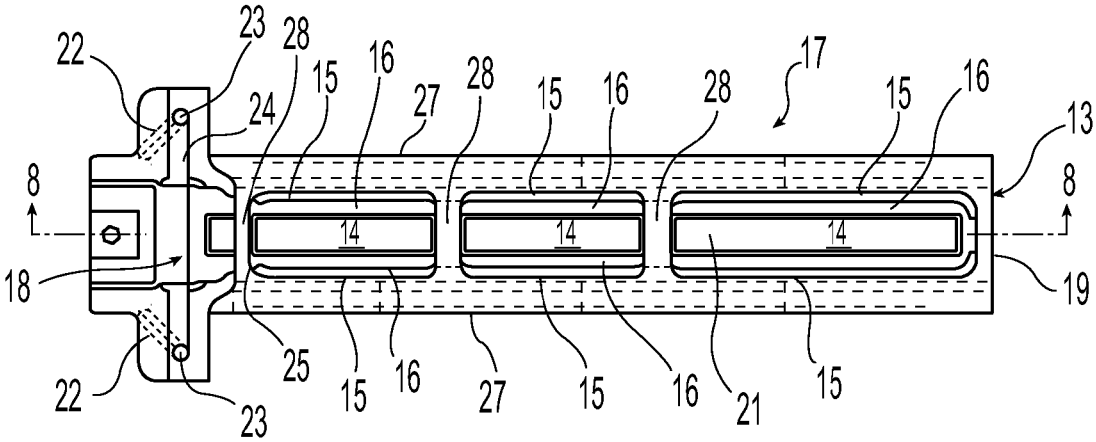
FIG. 7 is a plan view of an alternative segment of a metal delivery nozzle for use in the twin roll caster shown in FIG. 1.
Figure 8:
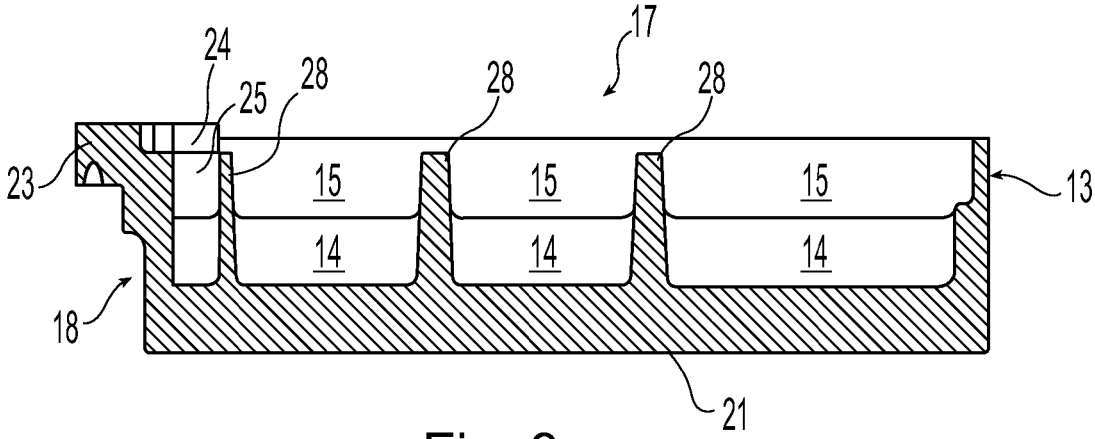
FIG. 8 is a cross-sectional side view taken along line 8-8 of the segment of the metal delivery nozzle shown in FIG. 7.

Referring to FIGS. 2-4, the delivery nozzle 10 is comprised of two segments 13, both similar to the one illustrated in FIG. 2 with segment end walls 19 positioned adjacent but spaced from each other. The inner trough 14 of each segment 13 extends lengthwise through the main portion 17 and into end portion 18. The inner trough 14 is formed of the segment side walls 15 with shoulder portions 30 and joined to at bottom portion 21 of the segment 13. Passages 16 may be formed of slots or holes 31 extending through the shoulder portions 30 along each side of the inner trough 14. The inner trough 14 extends from the end wall 19 through the main portion 17 to an opposite end wall in an end portion 18. The molten metal flows from the inner trough 14 through the passages 16, for example, to the outlets 20 in the bottom portion 21. The shoulder portion 30 may provide structural support to the segment 13 when the delivery nozzle 10 is loaded with molten metal during a casting campaign. In this embodiment, partitions 28, as shown in the alternative embodiment described below with reference to FIGS. 7 and 8, are not needed to provide structural support for the segment 13 when loaded with molten metal. As a result, the flow of molten metal from the outlets 20 into the casting pool 8 can be provided more laterally more evenly along each segment 13.

In operation, molten metal is poured from the metal distributor 4 through shroud 5 into the inner trough 14 of the segments 13 of the delivery nozzle 10. Several shrouds 5 may be provided along the length of the segments 13 of the delivery nozzle 10. The molten metal flows from the inner trough 14 into to the outlets 20 in this embodiment through passages 16. In some alternative embodiments, passage 16 may be shortened, changed, or be unnecessary, as desired, to provide flow of molten metal from the inner trough 14 to the outlets 20. In any case, the outlets 20 direct the flow of molten metal to discharge the molten metal laterally into the casting pool 8 in the direction of the meniscus between the surface 8A of the casting pool 8 and the casting surfaces 7 of the casting rolls 6.

As shown in FIGS. 2-4, the inner trough 14 extends substantially between the end walls of the segment 13 through the main portion 17 and into the end portion 18. Thus, the outlets 20 may extend substantially the bottom length of the segment 13, and may extend through most of the end portion 18 if desired. In this embodiment, the inner trough 14 extends part way through the end portion 18 of the segment 13. In any case, by extending the inner trough 14 and corresponding outlets 20 substantially along the bottom length of the segment 13, the flow of molten metal may be increased adjacent the segment end portion 18 in the "triple point" region. By this arrangement, more uniform flow of molten metal may be delivered to the casting pool 8 in the area adjacent the ends of the casting rolls 6, thereby reducing thinning of cast shells by maintaining more even delivery of molten metal in that area of the casting pool 8 and reducing washing away of the cast shells during casting.

Figure 5:
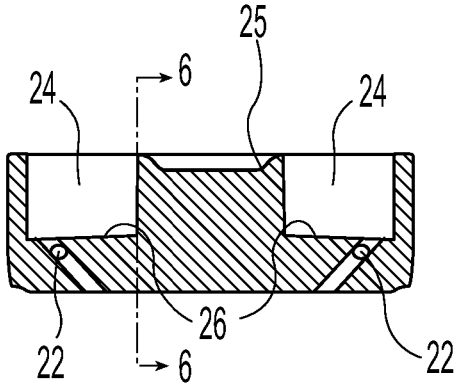
FIG. 5 is a cross-sectional transverse taken along line 5-5 the segment of the metal delivery nozzle shown in FIG. 2.
Figure 6:
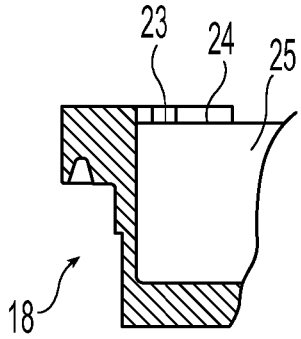
FIG. 6 is a cross-sectional transverse view taken along line 6-6 of the segment of the metal delivery nozzle shown in FIG. 5.

Referring to FIGS. 5-6, the assembly of the end portion 18 of the segment 13 positioned adjacent one of the ends of the casting rolls 6 includes reservoir portion 24. This "triple point" region is the area where skulls are more likely to form because of the different heat gradient adjacent a side dam. To compensate, molten metal is directed into the "triple point" region of the casting pool through slanted passageways 22 and outlets 23 in reservoir portion 24 positioned in the end portion 18 as shown in FIG. 5. The shape of the reservoir portion 24 is shown in FIGS. 5 and 6, with a bottom portion 26 shaped to cause the molten metal to flow through slanted passageways 22 toward the outlets 23. Longitudinally extending weirs 25 are also provided in the end portion of the segment 13 to separate the flow of molten metal from the inner trough 14 into the reservoir portion 24 and in turn into the "triple point" region, while allowing flow of molten metal from the inner trough 14 concurrently to outlets 20 through the passages 16. The height of the weirs 25 is selected to provide most effective flow of molten metal at a higher effective temperature into the "triple point" region to balance the difference in heat gradient in the "triple point" region.

Referring to FIGS. 2-6, molten metal may be directed from the reservoir portion 24 into the triple point region through slanted passageways 22 to outlets 23 in the end portion 18. As shown in FIGS. 2-6, the inner trough 14 may extend substantially to the end wall of the segment 13 in the end portion 18, with the reservoir portion 24 formed laterally in two parts integral with the side walls 15 of the segment 13. One or more weirs 25 may be provided in the segment 13 to separate the flow of molten metal from the inner trough 14 into the reservoir portions 24 and from there into the "triple point" region of the casting pool 8. It is contemplated that the segment 13 may not or may not include such weirs as desired in the particular embodiment.

Referring to FIG. 7-8, an alternative embodiment of the delivery nozzle 10 comprises two segments 13 (one shown), with each segment 13 having opposing side walls 15 and an upward opening inner trough 14, which extend lengthwise along segment 13 in the longitudinal direction through the main portion 17 and into end portion 18 of delivery nozzle 10. Partitions 28 extend between segment side walls 15 at spaced locations along the main portion 17, and provide structural support for the segment 13 of the delivery nozzle 10 when loaded with molten metal in operation. Passages 16 may be formed between the segment side walls 15 and inner trough 14. The passages 16 extend between the partitions 28 or between one partition 28 and an end portion 18 along the length of the segment 13. The passages 16 extend to side outlets 20 at a bottom portion 21 of the segment 13.

In each of the embodiments described above, the pair of segments 13 may be assembled lengthwise with the segment end walls 19 in abutting relation and the end portions 18 forming the outer ends of the segment 13 and delivery nozzle 10. Alternatively, delivery nozzle 10 may comprise a single segment 13, or more than two segments 13, that include all the features of, and effectively functions as, the pair of segments 13 as described herein. Further, segment 13 may include partitions 28, extending between segment side walls 15 to strengthen segment 13 under load of molten metal during a casting campaign. As shown in FIG. 1*a*, each segment 13 includes mounting flanges 27 that extend outward from segment side walls 15, either continuously (as shown in FIGS. 2 and 7) or intermittently, as desired, to mount segments 13 to assemble the delivery nozzle 10 in the casting apparatus 2. Since the side outlets 20 and the passages 16, if employed, extend along both sides of the main portion 17 and into end portion 18 of each segments 13, except at the partitions 28, a relatively uniform flow of molten metal can be provided along the length of the segments 13 even into the area adjacent the end of the casting rolls. Optionally, nozzle insert 34 may be provided, either as a single unit above or formed around partitions 28, or provided in parts capable of fitting between partitions 28 or between a partition 28 and an end portion 18. The assembly of the segments 13 of the metal delivery nozzle 10 is otherwise generally the same as that described above with reference to FIGS. 2-14.

Figure 9:
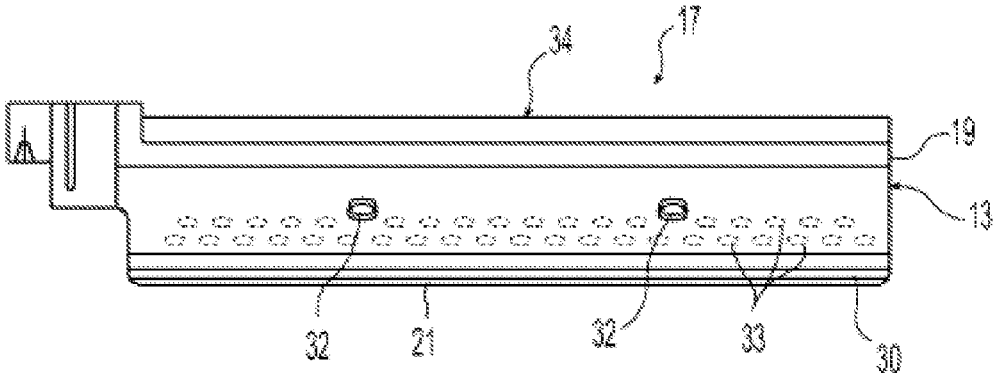
FIG. 9 is a side view of an another alternative segment of a metal delivery nozzle for use in the twin roll caster shown in FIG. 1.

Referring to FIG. 9, an alternative embodiment of each segment 13 of the delivery nozzle 10 is described, where each segment 13 is assembled in two pieces, with one piece being the inner trough 14 and the bottom portion 21 as shown. The other piece includes all of the other parts of the segment 13 as described above with reference to FIGS. 2-4. The two pieces are assembled together by use of ceramic pins 32, which extend through holes on the segment side walls 15 and into or through holes in the side portions of the inner trough 14. The ceramic pins provide structural support for the segments 13 and the delivery nozzle 10 when the delivery nozzle is loaded with molten metal during a casting campaign.

In the embodiment shown in FIG. 9, two or more offset rows of protrusions 33 are provided in the outside wall of inner trough 14. The protrusions 33 extend into passages 16 to provide a serpentine path to the flow of molten metal through passages 16 to the side outlets 20. Alternatively, some or all of the protrusions 33 may be provided on the inside surface of the segment side walls 15 as desired in the embodiment. In any case, successive rows of the protrusions 33 may be aligned or offset to provide the flow pattern as desired for the molten metal through passages 16. The assembly of the segments 13 of the metal delivery nozzle 10 is otherwise generally the same as that described above with reference to FIGS. 2-4.

Figure 10:
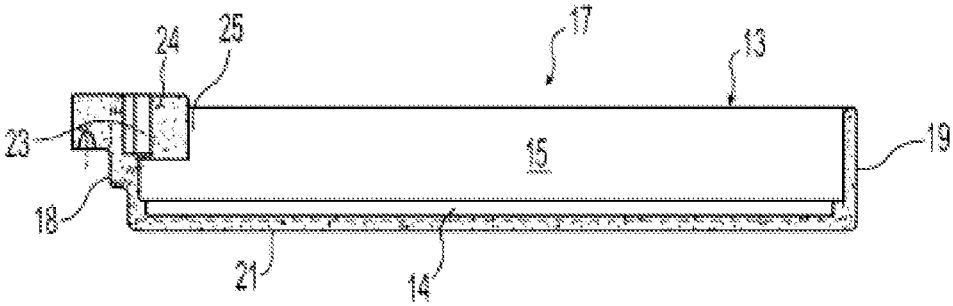
FIG. 10 is a cross-sectional side view of a further alternative segment of a metal delivery nozzle for use in the twin roll caster shown in FIG. 1.

In the embodiment shown in FIG. 10, the inner trough 14 extends under the reservoir portions 24, and is otherwise generally the same as that described above with reference to FIGS. 2-4.

Figure 11:
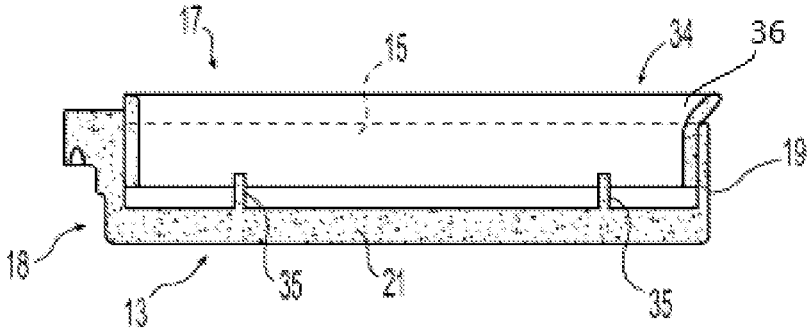
FIG. 11 is a cross-sectional side view of a further alternative segment of a metal delivery nozzle for use in the twin roll caster shown in FIG. 1 with an optional insert.

Referring now to FIG. 11, an alternative embodiment of the delivery nozzle 10 has segment 13 that includes support members 35 to provide structural support for a nozzle insert 34, which assists in directing the molten metal from the metal distributor 4 into the inner trough 14 of the segment 13 of delivery nozzle 10. The segment 13 shown in FIGS. 9-11 is generally the same as that shown in FIGS. 2-4 except as described below. A nozzle insert 34 protects the segment side walls 15 from wear due to the impact of the incoming molten metal, and also protects, at least in part, part of the inlets to the passages 16 from the inner trough 14 of the nozzle from wear from the impact of the incoming molten metal. The nozzle insert 34 thus generally reduces wear of the delivery nozzle 10 from the impact of the incoming molten metal, and also substantially reduces the amount of turbulence and disturbances in flow of molten metal adjacent the inlets to passages 16.

This embodiment of the delivery nozzle 10, including the nozzle insert 34 supported on the segment 13, directs a substantial portion of the incoming flow of molten metal from the metal distributor 4 to a substantially planar bottom inner trough 14 of the delivery nozzle 10, thereby increasing the useful life of the delivery nozzle 10 from the impact of incoming molten metal and substantially reducing the amount of turbulence and disturbances in flow of molten metal adjacent the inlets to passages 16. Further, in this embodiment, the nozzle insert 34 provides for a greater reception area for the flow of molten metal and thus further reduces the impact of the flow upon the segment 13 and reduces the risk for misaligned streams from the flow to cause unintended disturbances in the casting pool 8.

The nozzle insert 34 includes opposing side walls 36 that extend beyond the segment side walls 15 when the nozzle insert 34 is disposed within the segment 13. Additionally, the sidewalls flare beyond the top edges of the segment side walls 15 such that the upper surfaces extend over at least a portion of the top of the segment side walls 15. As shown, the upper surfaces fully extend beyond the segment side walls 15.

The nozzle insert 34 has opposing side walls, which extend lengthwise along the nozzle insert 34 in the longitudinal direction of nozzle insert 34 and define a channel for the flow of molten metal from the metal distributor 4 to the inner trough 14 of the segment 13. The nozzle insert 34 includes end walls and is dimensioned to fit with upper parts of segment side walls 15 forming inner trough 14 through the main portion 17 and into the end portion 18 for support as described below.

A pair of support members 35 may be placed in the bottom of the inner trough 14. The nozzle insert 34 is then placed above and generally within the inner trough 14 supported by the support members 35 and the segment side walls 15. During the casting process molten metal is then discharged by the metal distributor 4 through the nozzle insert 34 into inner trough 14 of the segments 13 of the delivery nozzle 10. The molten metal flows from the inner trough 14 into the passages 16, or the holes 31, and outwardly through the side outlets 20 adjacent bottom portions 21 of the segment 13 into the casting pool 8 below the meniscus.

The nozzle insert 34 is disposed above and may be within the inner trough 14. The nozzle insert 34 is supported relative to the segment 13 by the segment side walls 15 and a pair of support members 35. The pair of support members 35 space the nozzle insert 34 apart from the bottom of the inner trough 14 to provide space for the flow of molten metal into the passages 16, while dampening the flow of molten metal in the inner trough 14 of the segments 13 of the delivery nozzle. It must be understood, however, that the nozzle insert 34 may be supported relative to the segment 13 in any suitable manner. The nozzle insert 34 may be supported by portions of the segment 13, supported by any number of support members 35 engaging the segment 13, a combination thereof, or by a separate support from or engaging the segment 13, capable of supporting the nozzle insert 34 relative to the segment 13.

The end wall or side walls of each nozzle insert 34 may act as a weir to separate the flow of molten metal into the reservoir 24. Thus, it is contemplated that such an arrangement may not include the weir(s) 25, as shown in FIGS. 5-7. In such a case, the height of the insert end wall or side walls is selected to provide most effective flow of molten metal at a higher effective temperature into the reservoir 24 and on to the "triple point" region to normalize the difference in heat gradient in the "triple point" region. The nozzle insert 34 may be made of any refractory material, such as alumina graphite, the material of the segment 13 or any other material suitable for guiding the flow of incoming molten metal.

Figure 12:
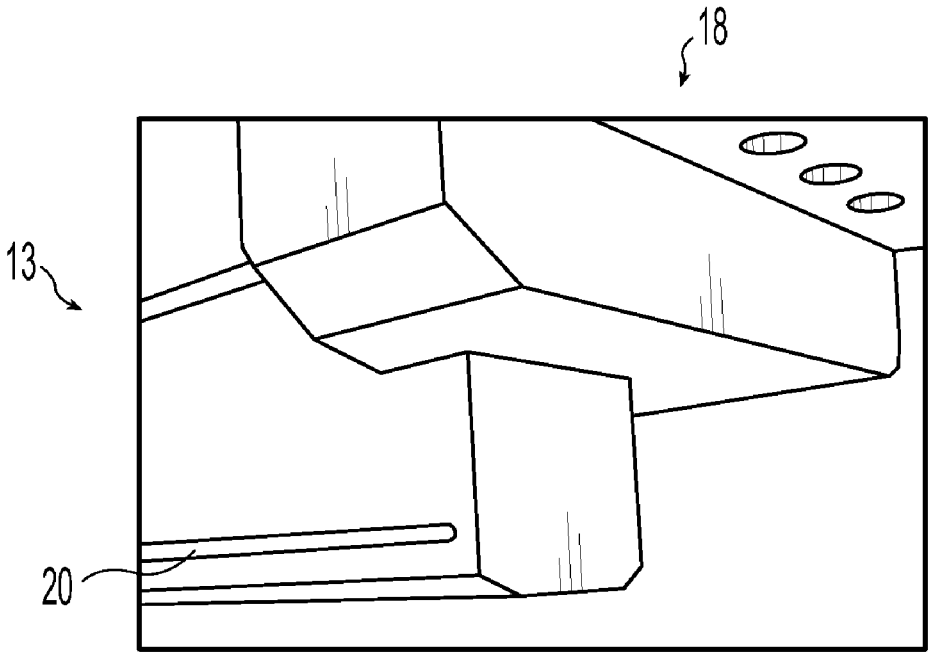
FIG. 12 is an end view of a metal delivery nozzle.
Figure 13:
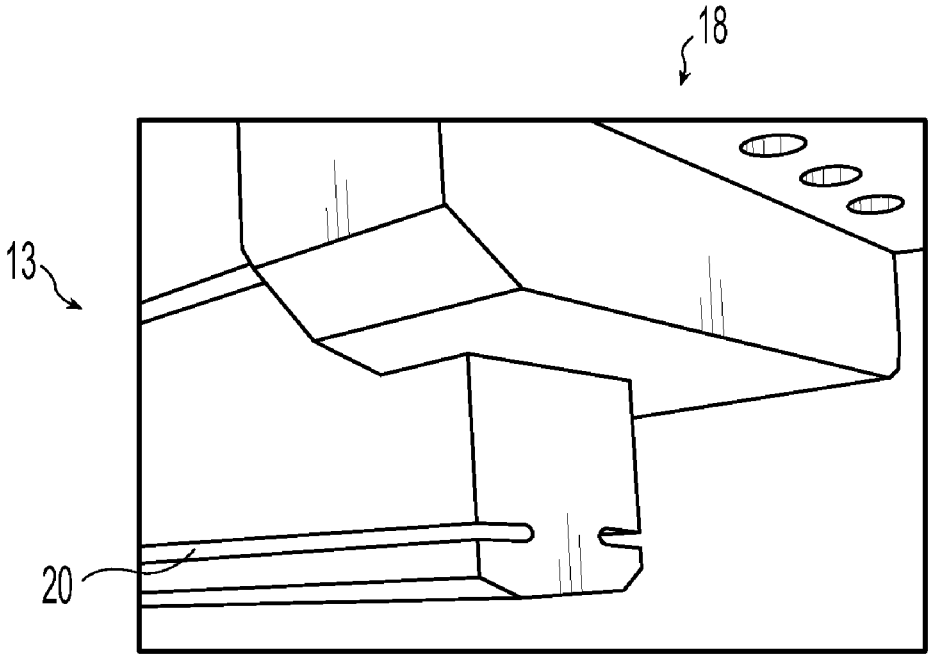
FIG. 13 is an end view of an alternative metal delivery nozzle.

As shown in FIGS. 12 and 13, the outlets 20 may include openings spaced longitudinally along the side walls adjacent the bottom part, such that molten metal is capable of exiting the delivery nozzle the side outlets in a substantially lateral direction into the casting pool. The outlets 20 may also include openings along the end walls adjacent the bottom part, such that molten metal is capable of exiting the delivery nozzle in a longitudinal direction into the casting pool. Thus, a delivery nozzle 10 may include outlets 20 having openings along both the side walls and end walls. An outlet with openings along the end wall may increase the flow of molten metal into the triple point region reducing skulls.

Figure 14:
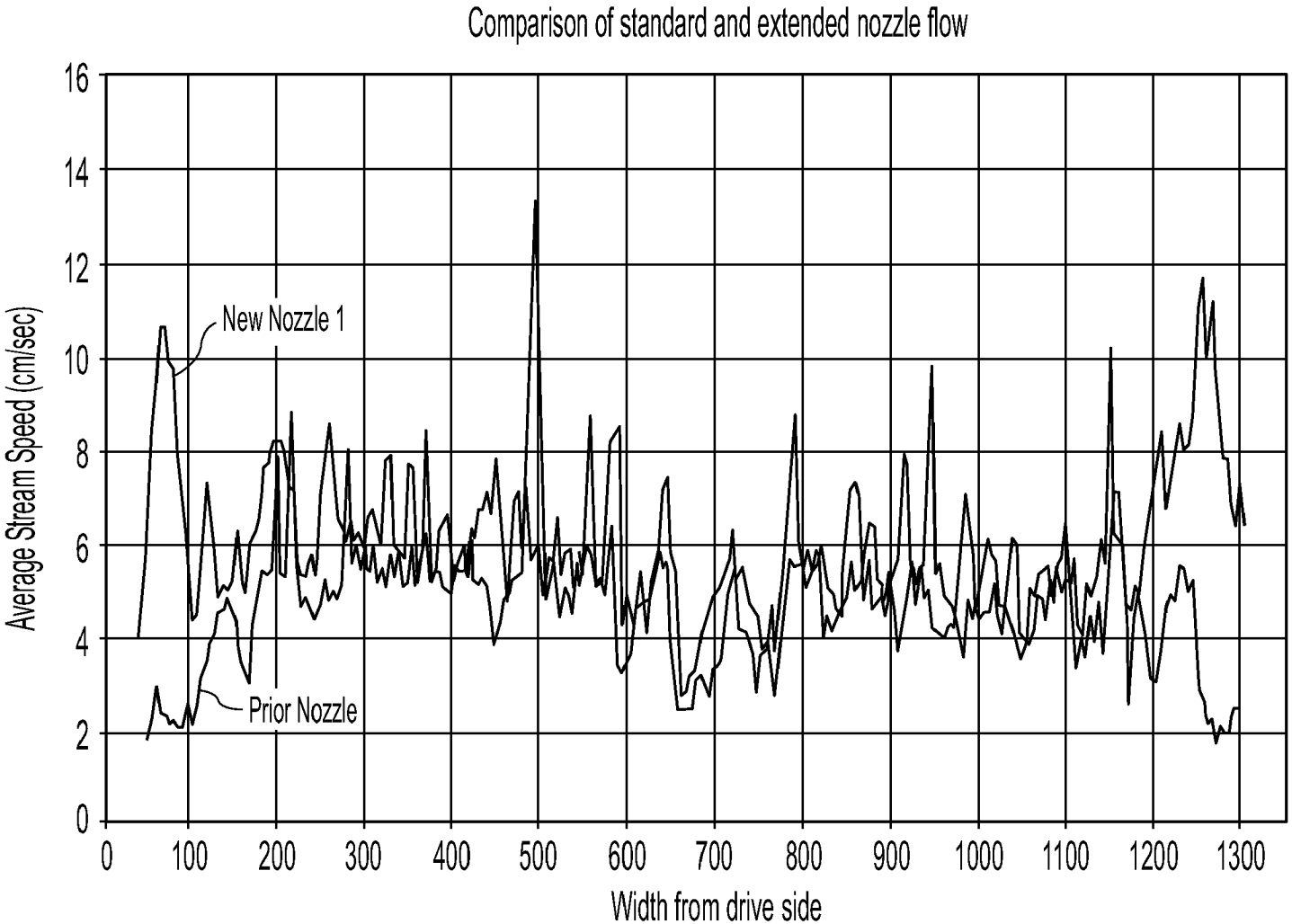
FIG. 14 is a graph of modeled flow through a first metal delivery nozzle in accordance with the present invention for use in a twin roll caster.
Figure 15:
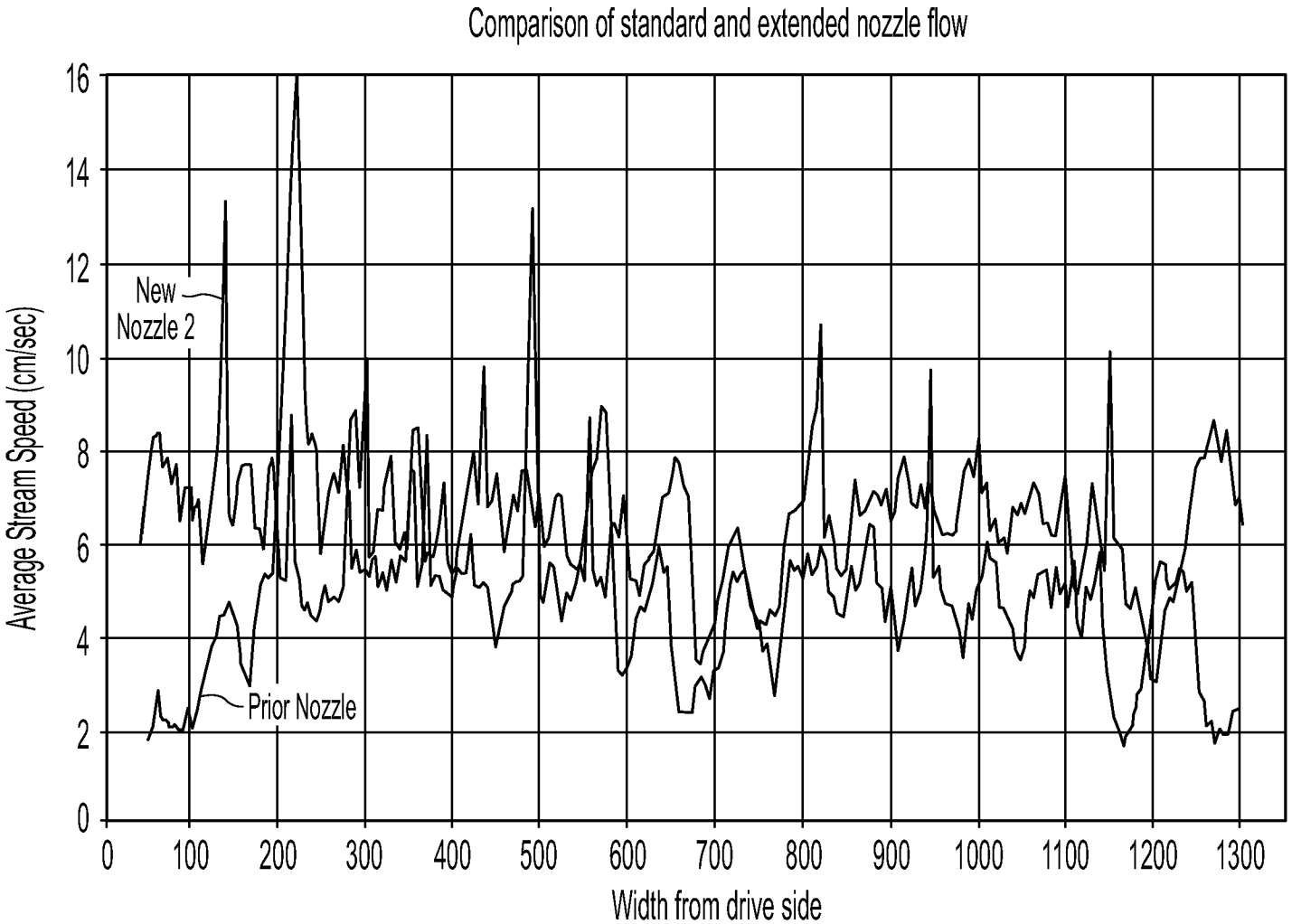
FIG. 15 is a graph of modeled flow through a second metal delivery nozzle in accordance with the present invention for use in a twin roll caster.

The flow rates/flow patterns through two delivery nozzles similar to the delivery nozzle 10 of FIGS. 2-6 are illustrated in FIGS. 14 and 15 with new nozzle 1 of FIG. 14 having 14 mm passages through the end portion to the triple point area and new nozzle 2 of FIG. 15 having 12 mm passages through the end portion to the triple point area. These FIGS. clearly demonstrate increased flow near the ends of the casting rolls as compared to prior nozzles.

It should be understood that the above described apparatus and method of casting thin strip are the presently contemplated best modes of embodying the invention. It is to be understood that these and other embodiments may be made and performed within the scope of the following claims. In each embodiment of the delivery nozzle, the nozzle insert dissipates a substantial part of the kinetic energy built up in the molten metal by reason of movement through the delivery system from the metal distributor to the delivery nozzle, and the resistance to movement of the molten metal from the inner trough through the passages to the side outlets further reduces the kinetic energy in the molten metal from the molten metal before reaching the casting pool. As a result, a more uniform and more quiescent flow of molten metal is provided to the casting pool to formation of the cast strip.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. A method of casting metal strip comprising:

(a) assembling a pair of casting rolls laterally disposed to form a nip between them, (b) assembling an elongated metal delivery nozzle extending along and above the nip between the casting rolls, with at least one segment having a main portion and an end portion having a reservoir portion having passages adapted to deliver molten metal to a casting pool and an inner trough extending longitudinally through the main portion and into the end portion beneath the reservoir portion, with end walls at opposite ends thereof, the inner trough communicating with outlets adjacent bottom portions formed in each segment adapted to deliver molten metal to the casting pool, (c) introducing molten metal through the elongated metal delivery nozzle to form a casting pool of molten metal supported on the casting rolls above the nip, such that molten metal is caused to flow into the inner trough of the delivery nozzle, from the inner trough through the outlets and through the reservoir portion passages into the casting pool, and (d) counter rotating the casting rolls to deliver cast strip downwardly from the nip.

2. The method as claimed in claim 1 where the inner trough has a bottom portion with a convex upper surface.

3. The method as claimed in claim 1 where the inner trough has a bottom portion with a concave upper surface.

4. The method as claimed in claim 1 where the reservoir portion in the end portion of each segment has parts on opposite sides of the inner trough and longitudinally extending weirs adjacent the side walls of the inner trough adapted to allow molten metal to flow over the weirs from the inner trough into the reservoir portion.

5. The method as claimed in claim 1 where the inner trough in the end portion of each segment extends under the reservoir portion, and has a weir positioned between the reservoir portion and the inner trough in the main portion of each segment adapted to allow molten metal to flow over the weir from the inner trough into the reservoir portion.

6. The method as claimed in claim 1 where the outlets in communication with the inner trough extend to adjacent to the end of each segment.

7. A metal delivery apparatus for casting metal strip comprising at least one elongated segment having a main portion and an end portion having a reservoir portion having passages adapted to deliver molten metal to a casting pool and an inner trough extending longitudinally through the main portion and into the end portion beneath the reservoir portion with end walls at opposite ends thereof, the inner trough communicating with outlets adjacent bottom portions formed in each segment adapted to deliver molten metal to the casting pool.

8. The metal delivery apparatus for casting metal strip as claimed in claim 7 where the inner trough has a bottom portion with a convex upper surface.

9. The metal delivery apparatus for casting metal strip as claimed in claim 7 where the inner trough has a bottom portion with a concave upper surface.

10. The metal delivery apparatus for casting metal strip as claimed in claim 7 where the reservoir portion in the end portion of each segment has parts on opposite sides of the inner trough and longitudinally extending weirs adjacent the side walls of the inner trough adapted to allow molten metal to flow over the weirs from the inner trough into the reservoir portion.

11. The metal delivery apparatus for casting metal strip as claimed in claim 7 where the inner trough of each segment extends under the reservoir portion in the end portion, and has a weir positioned between the reservoir portion and the inner trough in the main portion of each segment adapted to allow molten metal to flow over the weir from the inner trough into the reservoir portion.

12. The metal delivery apparatus for casting metal strip as claimed in claim 7 where the outlets in communication with the inner trough extend adjacent to the end of each segment.

* * * * *

UNITED STATES PATENT AND TRADEMARK OFFICE

CERTIFICATE OF CORRECTION

PATENT NO. : 8,047,264 B2
APPLICATION NO. : 12/403876
DATED : November 1, 2011
INVENTOR(S) : Brian E. Bowman, Rama Ballav Mahapatra and Peter A. Woodberry It is certified that error appears in the above-identified patent and that said Letters Patent is hereby corrected as shown below:

IN THE CLAIMS:

Column 9, line 6, Claim 6, "extend to adjacent" should read --extend adjacent--.

Signed and Sealed this
Thirteenth Day of March, 2012

David J. Kappos

David J. Kappos
*Director of the United States Patent and Trademark Office*